US009854896B2

(12) United States Patent
Veeder

(10) Patent No.: US 9,854,896 B2
(45) **Date of Patent: *Jan. 2, 2018**

(54) USE OF ADHESIVE PATCH AND TENSION STRAP TO REDUCE WRINKLES IN SKIN

(71) Applicant: Matthew P. Veeder, Shoreline, WA (US)

(72) Inventor: Matthew P. Veeder, Shoreline, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/445,796

(22) Filed: Feb. 28, 2017

(65) Prior Publication Data

US 2017/0164720 A1 Jun. 15, 2017

Related U.S. Application Data

(63) Continuation of application No. 14/335,828, filed on Jul. 18, 2014.

(51) Int. Cl.
*A61F 5/08* (2006.01)
*A45D 44/22* (2006.01)

(52) U.S. Cl.
CPC ..... *A45D 44/22* (2013.01)

(58) Field of Classification Search
CPC ..... A45D 44/002; A45D 44/22; A45D 27/38; A61F 13/122; A61F 5/30; A61F 5/32; A61B 2017/00747; A61B 2017/00761; A61B 17/132
See application file for complete search history.

(56) References Cited

U.S. PATENT DOCUMENTS

| | | | |
|---|---|---|---|
| 895,295 | A | 8/1908 | Paris |
| 2,184,099 | A | 12/1939 | MacDonald |
| 4,414,977 | A | 11/1983 | Rezakhany |
| 4,535,772 | A | 8/1985 | Sheehan |
| 5,116,675 | A | 5/1992 | Nash-Morgan |
| 5,533,499 | A | 7/1996 | Johnson |
| 5,533,503 | A | 7/1996 | Doubek et al. |
| 5,555,900 | A | 9/1996 | Rich |

(Continued)

OTHER PUBLICATIONS

Office action for U.S. Appl. No. 14/335,828, dated Feb. 2, 2016, Veeder, "Use of Adhesive Patch and Tension Strap to Reduce Wrinkles in Skin", 19 pages.

(Continued)

*Primary Examiner* — David C Eastwood
*Assistant Examiner* — Kankindi Rwego
(74) *Attorney, Agent, or Firm* — Lee & Hayes, PLLC; Benjamin A. Keim

(57) ABSTRACT

A wrinkle reducing pad is used to reduce wrinkles by applying tension to skin on a portion of the user's body, such as the face. An adhesive layer on the back of the wrinkle reducing pad is adhered to the skin, extending from a first point on the user's cheek, to a second point of the user's neck. A tension strap that is attached to one end of the adhesive pad is pulled to exert tension that tightly stretches the user's skin toward the neck. The tension strap is then removeably secured to the outer surface of the adhesive pad while maintaining the tension for a desired period of time. Since the adhesive pad adheres to the skin on the neck between the two points, it prevents wrinkles from forming there as a result of the tension applied by the tension strap.

14 Claims, 4 Drawing Sheets

(56) References Cited

U.S. PATENT DOCUMENTS

| | | | |
|---|---|---|---|
| 5,669,377 | A | 9/1997 | Fenn |
| 5,706,800 | A | 1/1998 | Cronk et al. |
| 5,735,272 | A | 4/1998 | Dillon et al. |
| 5,755,232 | A | 5/1998 | Kalt |
| 5,895,409 | A | 4/1999 | Mehdizadeh |
| 6,106,544 | A | 8/2000 | Brazeau |
| 6,155,999 | A | 12/2000 | Bartlett |
| 6,238,411 | B1 | 5/2001 | Thorner |
| 6,318,362 | B1 | 11/2001 | Johnson |
| 6,336,456 | B1 | 1/2002 | Ruben |
| 6,453,901 | B1 | 9/2002 | Ierulli |
| 6,478,023 | B1 | 11/2002 | Lockwood |
| 6,603,051 | B1 | 8/2003 | Beaudry |
| 6,631,714 | B2 | 10/2003 | Von Duyke et al. |
| 6,860,263 | B1 | 3/2005 | Scoggins |
| 6,863,066 | B2 | 3/2005 | Ogle |
| 6,982,359 | B1 | 1/2006 | Beaudry |
| 7,022,891 | B2 | 4/2006 | Beaudry |
| 7,067,710 | B1 | 6/2006 | Beaudry |
| 7,798,141 | B2 | 9/2010 | Veeder |
| 8,322,059 | B2 | 12/2012 | Henshaw |
| 2001/0023695 | A1 | 9/2001 | Auriemma |
| 2002/0000227 | A1 | 1/2002 | Duyke et al. |
| 2003/0000521 | A1 | 1/2003 | Beaudry |
| 2003/0005938 | A1 | 1/2003 | Lockwood |
| 2004/0153019 | A1 | 8/2004 | Beaudry |
| 2006/0000472 | A1 | 1/2006 | Fenton |
| 2006/0229545 | A1* | 10/2006 | Zaguroli, Jr. ..... A61B 17/085 602/58 |
| 2008/0228217 | A1* | 9/2008 | Friend ..... A45D 44/22 606/204.35 |
| 2009/0163947 | A1 | 6/2009 | Lam |
| 2009/0183734 | A1 | 7/2009 | Kwok et al. |
| 2011/0295311 | A1* | 12/2011 | Adelman ..... A45D 44/22 606/204.35 |
| 2013/0032502 | A1 | 2/2013 | Anderson et al. |
| 2013/0291888 | A1 | 11/2013 | Heyniger |
| 2016/0015154 | A1 | 1/2016 | Veeder |

OTHER PUBLICATIONS

Office action for U.S. Appl. No. 11/198,659, dated Apr. 26, 2010, Matthew P. Veeder, "Manually Adjustable Nasal Cavity Dilator", 6 pages.

Office action for U.S. Appl. No. 11/198,659, dated Apr. 29, 2009, Matthew P. Veeder, "Manually Adjustable Nasal Cavity Dilator", 21 pages.

Office action for U.S. Appl. No. 14/335,828, dated Aug. 4, 2016, Veeder , Use of Adhesive Patch and Tension Strap to Reduce Wrinkles in Skin, 16 pages.

Office action for U.S. Appl. No. 11/198,659, dated Sep. 2, 2009, Matthew P. Veeder, "Manually Adjustable Nasal Cavity Dilator", 23 pages.

PCT Search Report and Written Opinion dated Oct. 13, 2015 for PCT Application No. PCT/US15/40598, 11 pages.

* cited by examiner

USE OF ADHESIVE PATCH AND TENSION STRAP TO REDUCE WRINKLES IN SKIN

CROSS-REFERENCE TO RELATED APPLICATIONS

This application is a continuation of and claims priority to co-pending, commonly owned U.S. patent application Ser. No. 14/335,828 filed Jul. 18, 2014, and entitled "Use Of Adhesive Patch And Tension Strap To Reduce Wrinkles In Skin," which is herein incorporated by reference in its entirety.

BACKGROUND

Millions of dollars are spent each year on products and procedures to reduce facial wrinkles, in an attempt to delay the evidence of aging and to reduce the adverse effects of exposure of the skin to sunlight. Currently non-surgical options for reducing or even eliminating such wrinkles—at least temporarily, include the use of injected substances, such as dermal fillers, or muscle relaxers, e.g., Botulinum toxin. Hyaluronic acid, synthetic fillers, or even a patient's own body fat can be injected into the folds of the skin to change its contours, yielding a more youthful appearance. Other options for reducing wrinkles include chemical peels in which an acid is applied to the epidermal layer to enable dead skin cells to be peeled off, microdermabrasion in which fine crystal of an abrasive are applied to sand the skin, and the use of lasers and intense pulsed light, or heat treatments. Non-ablative and ablative laser or treatments actually provide a controlled damage to the skin, which promotes the body to respond by producing collagen that fills in or plumps the skin to reduce wrinkles. The greater the amount of damage, the more benefit that will be derived, since more collagen will be produced; however, more damage to the skin causes redness and will require longer periods to heal. Heat treatments also promote collagen production and tightening of existing collagen.

Many of the treatments noted above are relatively expensive and may require time to realize the benefits and allow the adverse side effects to heal. For this reason, cosmetic facial creams have been developed that are intended to reduce wrinkles in facial skin by moisturizing, smoothing, and tightening the skin in the region to which the creams are applied. The efficacy of such creams can vary, but none offer more than a temporary palliative.

Other non-surgical facial wrinkle treatments involve stretching the skin. One of the causes of wrinkles is the loss of muscle tone and resilience in facial tissue. By applying a force to the affected area that slightly stretches the dermal layer and smooths the wrinkles for a period of time, a reduction of the wrinkles in the skin that was stretched remains evident for at least a day or so. Regular application of such a stretching force on a daily basis can have an even more beneficial result in reducing wrinkles and providing better skin tone.

A system for applying a force to stretch skin in an area subject to wrinkles using an elastomeric strip or string is known in the art. Pads supporting the elastomeric strip or string are adhesively attached to skin at disparate points on the user's skin, so that the elastic force provided by the device tends to pull the disparate points toward each other, to stretch the skin adjacent to these points. However, this approach also tends to create wrinkles in the skin disposed between the disparate points, since the elastomeric force pulls the points towards each other. While reducing wrinkles in a portion of the skin to adjacent to where the apparatus is applied, it thus increases wrinkles between the two adhesive pads. Furthermore, although the user can initially set the tension applied to the disparate points on the skin, if used at night, the elastomeric strip or string can give and stretch when pushed against a pillow, thereby changing the tension force set by the user's adjustment.

It would therefore be desirable to provide a tension force to stretch skin subject to wrinkles, thereby smoothing the skin for a period of time, but without causing wrinkles in other portions of the user's skin. Thus, it would be desirable to prevent the apparatus being used to stretch the skin to reduce wrinkles from also causing wrinkles where the apparatus is being used. Further, it would be desirable for contact with a pillow to not alter the force applied by the apparatus.

SUMMARY

One aspect of the present approach is thus directed to apparatus for reducing wrinkles in a region of skin on a user. The apparatus includes an adhesive pad having a first end and a second end opposite the first end, and a first surface and a second surface opposite the first surface. An adhesive material is included on the first surface and is selected for removeably adhering the adhesive pad to the skin of the user. A tension strap has a fixed end that is attached to the second surface of the adhesive pad at either its first end or second end. A free end of the tension strap that is opposite the fixed end can be pulled to create a desired tension acting on the skin adjacent to where the adhesive pad is adhered. An attachment material removeably secures the free end of the tension strap to the upper surface of the adhesive pad at a position that maintains the desired tension. The attachment material is applied to one or both of an undersurface of the tension strap and the second surface of the adhesive pad.

Another aspect of the present approach is directed to a method for reducing wrinkles in a desired region of skin on a user. The method includes adhering an adhesive material on an adhesive pad to an area of skin that is adjacent to the desired region of skin where the wrinkles are to be reduced. A first end of the adhesive pad is then pulled toward a second end of the adhesive pad to create a tension in the skin in the desired region. The tension flattens wrinkles in the desired region. This tension in the skin in the desired region is then maintained for an extended period of time. The adherence of the adhesive pad to the skin keeps the skin under the adhesive pad from wrinkling and thereby prevents wrinkles from being created under the adhesive pad as a result of the tension maintained on the skin in the desired region.

Yet another aspect of the present approach is directed to a kit for reducing wrinkles in a desired region of skin on a user. The kit includes an adhesive pad that has an adhesive material on one surface for adhering the adhesive pad to an area of skin adjacent to a desired region of skin where wrinkles are to be reduced. A tension strap has one end fixed to the adhesive pad and has a free end opposite the one end that can be pulled to create a selected tension in the skin within the desired region. Further, the tension strap includes an attachment material on an undersurface to attach the free end of the tension strap to an outer surface of the adhesive pad to maintain the selected tension. Also included in the kit are instructions explaining how the user is to adhere the adhesive material on the one surface of the adhesive pad to the area of skin. The instructions also explain how to maintain the adhesive pad in conformance with the skin in the area while pulling the free end of the tension strap to create the selected tension in the desired region, and how to removeably attach the free end of the tension strap to the outer surface of the adhesive pad to maintain the selected tension in the skin of the desired region for an extended period of time.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 3A:
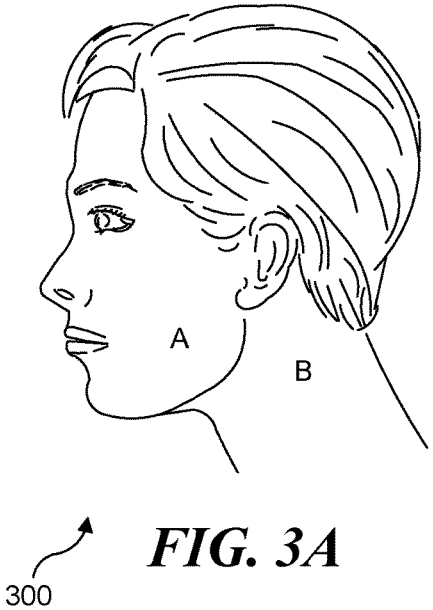
FIG. 3A is a graphic left side view of a woman's face.
Figure 3B:
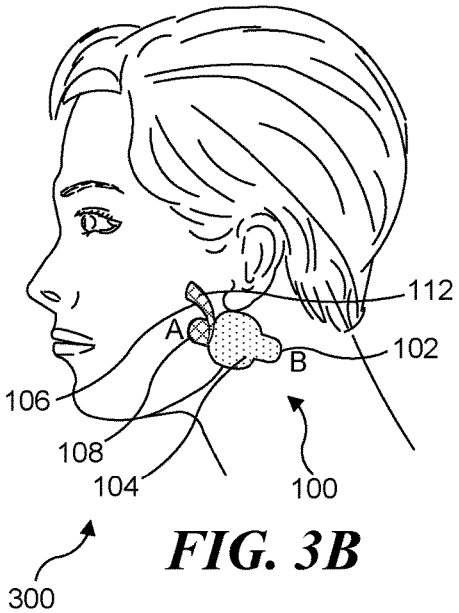
FIG. 3B is the view of FIG. 3A, showing the exemplary wrinkle reducing pad applied to the woman's face, extending between her cheek and the side of her neck.
Figure 3C:
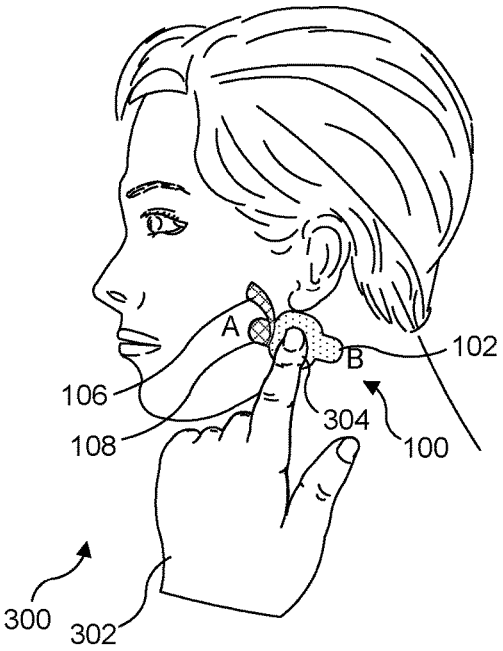
FIG. 3C is the view of FIGS. 3A and 3B, showing how pressure is applied to the center of the adhesive pad with a user's finger, while the tension strap is adjusted to set the tension between a first point where the wrinkle reducing pad is attached to the cheek and a second point where it is attached to the side of the neck.
Figure 3D:
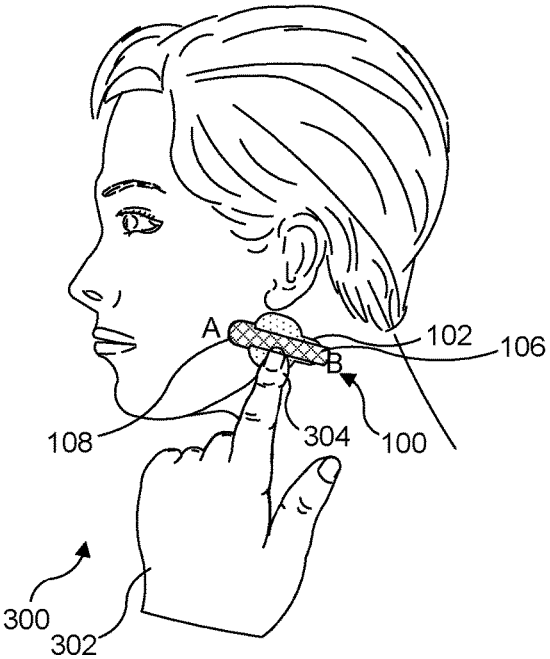
Figure 4:
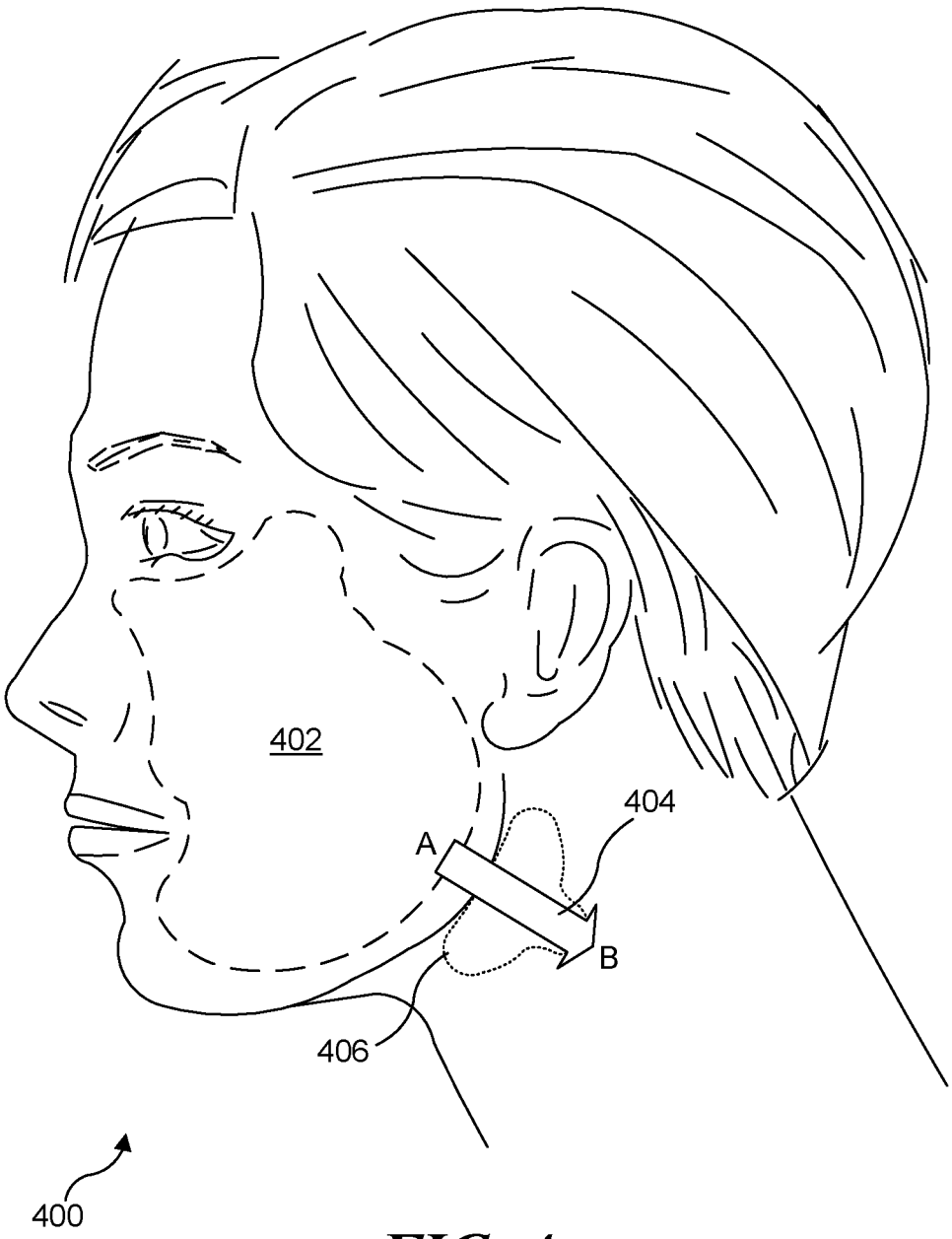

FIG. 3D is the view of FIGS. 3A, 3B, and 3C, showing how the tension strap is secured to the wrinkle reducing pad to maintain the tension, as the finger holding the wrinkle reducing pad against the skin of the user is withdrawn; and FIG. 4 is the graphic view of FIG. 3A, illustrating the areas where wrinkles are reduced by using the wrinkle reducing, and showing an area on the neck where wrinkles are prevented from being formed when the exemplary adhesive pad is applied as described herein.

DESCRIPTION

Figures and Disclosed Embodiments are Not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein. Further, it should be understood that any feature of one embodiment disclosed herein can be combined with one or more features of any other embodiment that is disclosed, unless otherwise indicated.

Exemplary Embodiment

Figure 1:
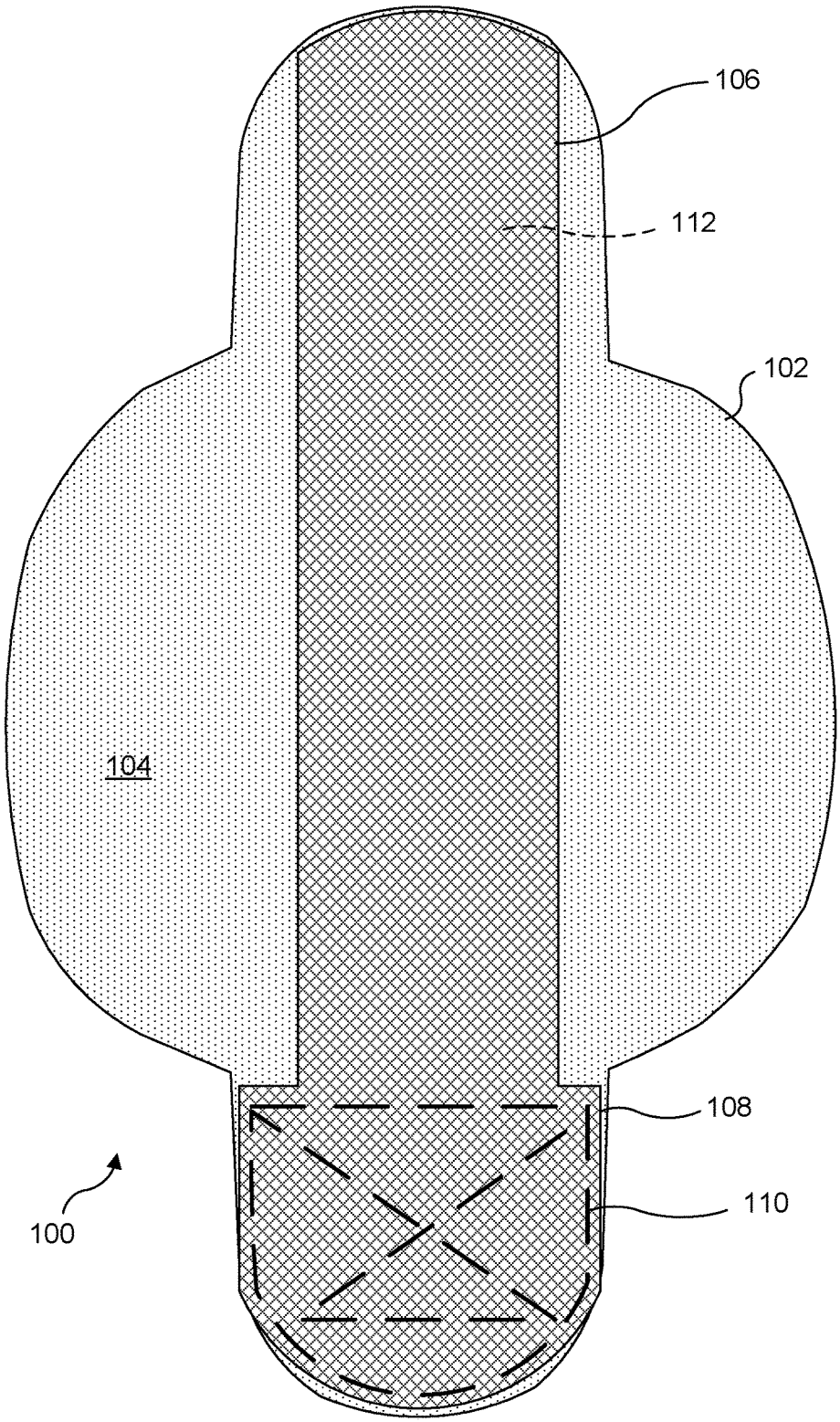
FIG. 1 is a plan view of one side of an exemplary wrinkle reducing pad that can be applied to the skin of a user to reduce wrinkles in an adjacent area of the skin, without causing wrinkles where the adhesive pad is applied, showing a tension strap that can be used to vary the amount of force applied to the skin.

An exemplary embodiment of a wrinkle reducing patch 100 for reducing wrinkles in the skin on the side of a user's face is illustrated in FIG. 1. This view shows the outer surface of patch 100. The patch includes an adhesive-backed pad 102, which can have many different shapes, an example of one of which is shown for this embodiment. The adhesive coating is on the underside of pad 102 (i.e., not visible in this view). For this exemplary embodiment, the outer surface of pad 102, which is partially exposed in this view, includes a layer of hook material 104. Permanently attached to one end of pad 102 is a tension strap 106. Tension strap 106 includes an attachment area 108, which in this exemplary embodiment is connected to pad 102 using lines of stitching 110 that extend around the perimeter of that end of the pad and around the perimeter of the attachment area, as well as forming an "X" in the center of attachment area 108. It is contemplated that attachment area 108 of tension strap 106 might instead be thermally bonded to the end of pad 102, or could instead be adhesively attached using a suitable fabric adhesive material, or can be attached using one or more metal or plastic rivets. As a further alternative, the tension strap might be formed by simply extending the end of pad 102, shaping the extended end as tension strap 106, and folding the extended end over the rest of pad 102.

The undersurface of tension strap 106 (not directly visible in this view) is covered by a loop material 112. When loop material 112 is pressed against hook material 104, the hook material removeably engages loop material 112, which enables the free end of tension strap 106 that is not permanently attached to pad 102 to be affixed to pad 102 at almost any selected position along the length of the pad. The significance of this selective attachment of tension strap 106 to pad 102 will be evident from the explanation regarding the use of the wrinkle reducing pad as discussed below.

It should also be noted that in an alternative exemplary embodiment, hook material 104 can be applied on the undersurface of tension strap 106 and loop material 112 can be applied to the outer surface of pad 102. Also, instead of using a hook and loop fastener mechanism to secure tension strap 106 at a selectively determined position along the length of pad 102, a refastenable adhesive material can instead be applied to the undersurface of tension strap 106 and/or to the outer or upper surface of pad 102. Such refastenable adhesives are readily available from commercial sources and are formulated to enable two surfaces to be adhesively secured, pulled apart, and again adhesively secured several times before the adhesive qualities of the material become ineffective.

Figure 2:
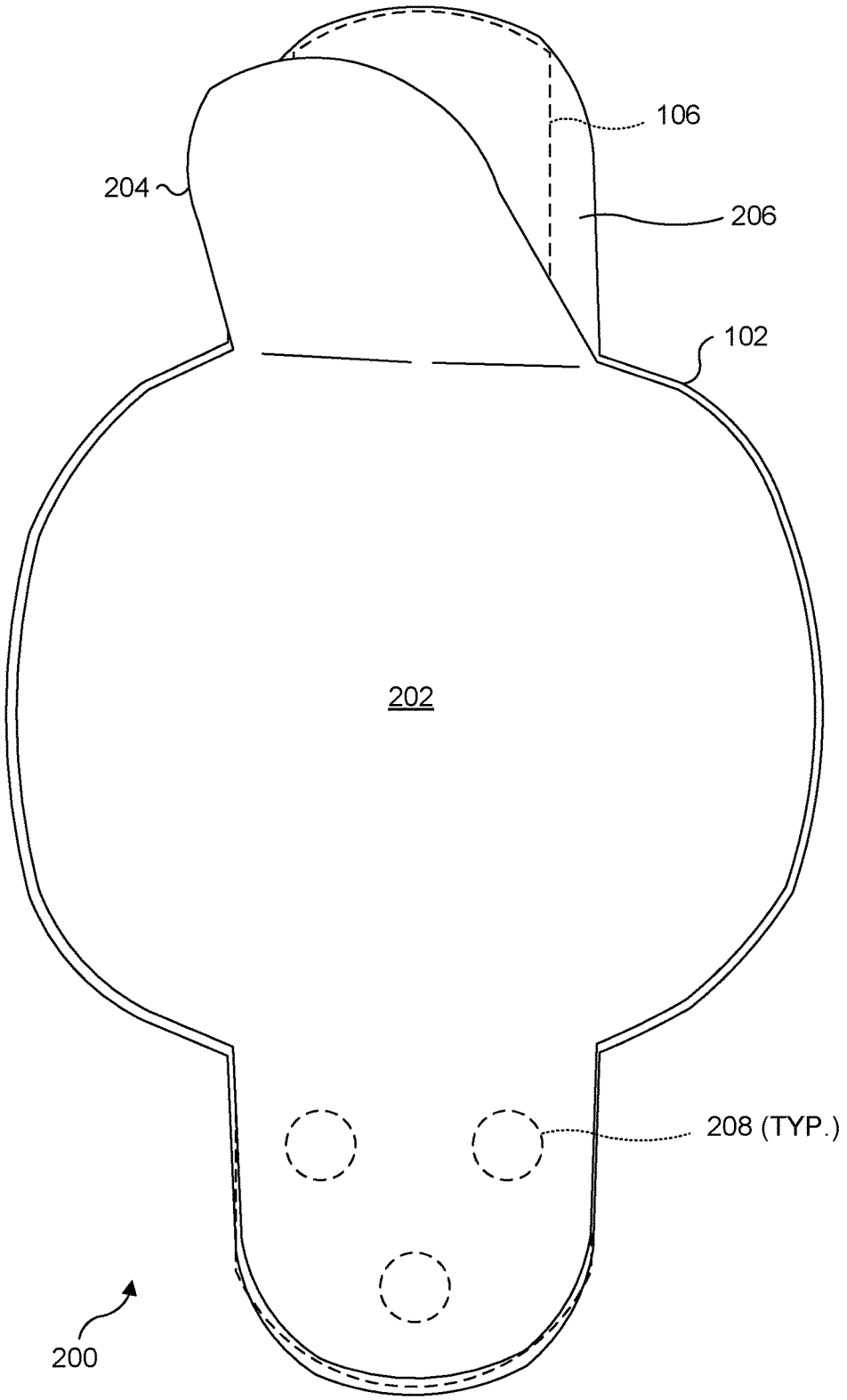
FIG. 2 is a plan view of an opposite side of the exemplary wrinkle reducing pad of FIG. 1, showing how a protective sheet covering an adhesive layer on the wrinkle reducing pad can be pulled away to fully expose the adhesive layer just before the wrinkle reducing pad is applied to a user's skin.

FIG. 2 illustrates an underside 200 of the wrinkle reducing pad, showing a protective sheet 202 that covers an adhesive layer 206 extending over the surface of adhesive pad 102. Just before the adhesive pad is to be applied to the skin of a user at a desired location, an end 204 of the protective sheet is lifted away from adhesive layer 206 as shown in the Figure, and the protective sheet is grasped, e.g., between a thumb and forefinger and completely pulled away from adhesive layer 206. Adhesive layer 206 comprises an adhesive material that is selected to effectively adhere to human skin, for example, the type of adhesive material commonly used on adhesive bandages. In this exemplary embodiment, a plurality of rivets 208 made of either plastic or metal are employed to attach tension strap 106 to one end of adhesive pad 102, as shown in phantom beneath protective sheet 202. Protective sheet 202 can comprise a paper, plastic, and/or resin material that slightly adheres to adhesive layer 206, but which readily releases from the adhesive layer when pulled away as shown in FIG. 2.

FIG. 3A illustrates a user 300, who will be applying the wrinkle reducing pad before retiring to sleep. Although user 300 is illustrated in this example as being a female, it will be understood that the wrinkle reducing pad can also be used by a male user to reduce wrinkles. Before applying the wrinkle reducing pad, user 300 thoroughly cleanses the side of her face, from the area adjacent to a first point A, extending all the way to a side of her neck, adjacent to a second point B. The cleansing is done using soap and optionally a washcloth (not shown), and that area of the user's skin is then rinsed well with water to remove any residue of oils or lotions that may have been present on that portion of the face and neck. The area is then dried with a clean towel.

Next, as shown in FIG. 3B, after peeling away protective sheet 202 to expose adhesive layer 206 on the wrinkle reducing pad, the user lifts the free end of tension strap 106 and positions adhesive pad 102 so that it extends over the cleansed area, from the side of her face to her neck, under her ear lobe. One end of adhesive pad 102 is thus applied adjacent to first point A and the adhesive pad extends so that the other end of the adhesive pad is disposed adjacent to second point B. Adhesive layer 206 contacts and bonds to the user's skin where the pad is applied, forming a smooth contour with the skin.

As shown in FIG. 3C, while the free end of tension strap is still lifted away from adhesive pad 102, the user (or an assistant) places a finger firmly against adhesive pad 102, applying pressure against the adhesive pad at the neck, adjacent to the jaw of the user. This digital pressure applied to adhesive pad 102 ensures that the adhesive layer remains bonded to the skin in the area between first point A and second point B as tension is applied by the adhesive pad between first point A and second point B. While maintaining the pressure against the adhesive pad with the finger, the free end of tension strap 106 is then pulled toward second point B, so that skin on the user's cheek is drawn tightly by the tension toward second point B on the user's neck.

As shown in FIG. 3D, tension strap 106 is secured in place by engaging hook material 104 with loop material 112, to maintain the tension applied to the skin on the user's cheek by tension strap 106, as the finger applying pressure to the adhesive pad is withdrawn. The wrinkle reducing pad is thus adherently secured to the user's skin and the tension selectively determined by tension strap 106 continues to stretch out and eliminate wrinkles in the skin of the user. User 300 can optionally sleep with the wrinkle reducing pad in place as shown in FIG. 3D. However, it must be emphasized the wrinkle reducing pad can be applied and remain in place when the user remains awake and need not be applied for use while the user will be asleep. It should also be understood that while the present example illustrated in FIGS. 3A-3D shows the wrinkle reducing pad applied to the left side of the user's face and neck, it can instead be applied to the right side in a similar fashion. Further, it will be understood that even more benefit will be obtained by the user applying wrinkle reducing pads in this manner to both sides of the face and neck during the same extended period of time—either whether while the user is asleep or awake.

When the user desired to remove the wrinkle reducing pad, tension strap 106 can be pulled away from adhesive pad 102, so that hook material 104 disengages from loop material 112. Adhesive layer 206 can then be peeled away from the user's skin. It is contemplated that the user might reuse wrinkle reducing pads several times, but with each use, the adhesive strength of adhesive layer 206 will be reduced and it will eventually no longer adhere adequately to the user's skin.

FIG. 4 is a graphic image 400 illustrating how the wrinkle reducing pad helps to reduce wrinkles in a region 402 of the user's cheek and face extending from first point A toward the user's mouth, nose, and eye by applying tension as indicated by an arrow 404 toward second point B on the user's neck. However, unlike other products that are intended to reduce wrinkles in a user's face, the present novel approach prevents wrinkles from forming in the skin on the user's neck in a region 406, which would occur if the tension were applied with an elastomeric strap extending between first point A and second point B. By adherently applying adhesive pad 102 to the area proximate region 406 before the tension is applied with tension strap 106 as described above, the adhesive pad keeps the skin in region 406 flat so that wrinkles are not created in that region. Thus, the user benefits from the stretching provided by the tension without the detrimental formation of wrinkles in region 406. Although the wrinkles are reduced in region 402 for period of time following a single use of the wrinkle reducing pad for several hours, repeated use of the wrinkle reducing pad (i.e., for 6-8 hours/use) provides longer lasting benefits. For example, if the wrinkle reducing pad is worn on each side of a user's face each time that the user is asleep, when the user is awake, the skin in region 402 should have fewer wrinkles and have better muscle tone and a more youthful appearance. It should be understood that the wrinkle reducing pad is not just designed to help reduce existing wrinkles. Another important function of the wrinkle reducing pad is to help prevent wrinkles from even forming on a user's face. The device is designed to decrease the early onset of wrinkle formation on the face that can occur when a pillow pushes a person's facial skin into folds, which is a primary cause of wrinkle development and wrinkle aggravation of facial skin.

The wrinkle reducing pad can be sold in a kit that includes instructions explaining how the adhesive pad is to be adhered to the skin of the user, for example, to cover an area extending between the user's cheek and neck, as discussed above. Other details provided in the instructions will generally conform to the method of using adhesive pad 102, and tension strap 106 to create a selected or desired tension in the skin of a region adjacent to where the adhesive pad is adhered.

It will be appreciated that the present novel approach can be employed in reducing wrinkles in other portions of the user's body. For example, it might be used to reduce wrinkles immediately over a user's eyes if the tension were applied toward the hairline, while maintaining the skin on the upper forehead flat and wrinkle free. There are potential uses for this device in the medical field where it might be employed to treat tears in the skin, lacerations, or surgical wounds.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

What is claimed is:

1. A method for reducing wrinkles in a desired region of skin on a user, comprising:

a) adhering an adhesive material on a first adhesive pad to a first area of skin that is adjacent to the desired region of skin where the wrinkles are to be reduced, the desired region of skin extending toward a nose and eyes of the user;

b) pulling a first end of the first adhesive pad that is adhered to a first cheek of the user toward a second end of the first adhesive pad to create a first tension in the skin in the desired region, the first tension flattening wrinkles in the desired region;

c) adhering an adhesive material on a second adhesive pad to a second area of skin that is adjacent to the desired region of skin where the wrinkles are to be reduced;

d) pulling a first end of the second adhesive pad that is adhered to a second cheek of the user toward a second end of the second adhesive pad to create a second tension in the skin of the user, the second tension flattening wrinkles in the desired region; and e) maintaining the first tension and the second tension in the skin in the desired region for an extended period of time, the first adhesive pad and the second adhesive pad keeping the skin from wrinkling under the first adhesive pad and the second adhesive pad respectively, and thereby preventing wrinkles from being created under either the first adhesive pad or the second adhesive pad as a result of the first tension and the second tension maintained in the desired region, wherein the second adhesive pad creates the second tension in a generally opposite direction from the first tension created by the first adhesive pad.

2. The method of claim 1, wherein a tension strap attached to one end of the first adhesive pad is pulled to create the first tension in the skin in the desired region.

3. The method of claim 1, wherein the adhesive material on the first adhesive pad is adhered to the first area of skin that is adjacent to the desired region of skin just before the user intends to sleep for the extended period of time, the method further comprising removing the first adhesive pad from the first area of skin after the user awakens.

4. The method of claim 1, further comprising peeling away a protective sheet from the adhesive material on the first adhesive pad before applying the adhesive material on the first adhesive pad to the first area of skin, thereby exposing the adhesive material on the first adhesive pad so that the adhesive material on the first adhesive pad can be adhered to the skin of the user in the first area of skin.

5. The method of claim 4, wherein maintaining the first tension in the skin in the desired region comprises engaging a hook material applied on one of an undersurface of the tension strap and an outer surface of the first adhesive pad with a loop material applied on the other of the undersurface of the tension strap and the outer surface of the first adhesive pad to hold a free end of the tension strap in place after it is pulled to create the first tension.

6. The method of claim 2, wherein maintaining the tension in the skin in the desired region comprises adhering a refastenable adhesive material disposed on at least one of an undersurface of the tension strap and an outer surface of the first adhesive pad with the other of the undersurface of the tension strap and the outer surface of the first adhesive pad to hold a free end of the tension strap in place after it is pulled to create the first tension.

7. The method of claim 2, where pulling the first end of the first adhesive pad toward the second end of the first adhesive pad to create the first tension in the skin in the desired region includes applying digital pressure against an outer surface of the first adhesive pad so that it conforms to the first area of skin as the tension in the skin in the desired region is created by pulling the tension strap.

8. A method for reducing wrinkles in a desired region of skin on a user, comprising:

a) adhering a first adhesive pad to a first area of skin extending from a first cheek of the user onto the neck of the user, the first adhesive pad having a first tension strap;

b) pulling a free end of the first tension strap to create a first tension between a first end of the first adhesive pad on the first cheek of the user and a second end of the first adhesive pad on a neck of the user, the first tension flattening wrinkles;

c) adhering a second adhesive pad to a second area of skin extending from a second cheek of the user onto the neck of the user, the second adhesive pad having a second tension strap;

d) pulling a free end of a second tension strap to create a second tension between a first end of the second adhesive pad on the second cheek of the user and a second end of the second adhesive pad on the neck of the user; and e) maintaining the first tension and the second tension for a period of time, the first adhesive pad and the second adhesive pad keeping skin from wrinkling under the first adhesive pad and the second adhesive pad respectively, thereby preventing wrinkles from being created under the first adhesive pad or the second adhesive pad.

9. The method of claim 8, further comprising:

peeling a protective sheet off of the first adhesive pad before applying the first adhesive pad to the area of skin, the protective sheet being removably attached to the first adhesive pad, thereby exposing an adhesive material.

10. The method of claim 8, wherein the first adhesive pad and the second adhesive pad are adhered to the user before the user goes to sleep, and further comprising removing the first adhesive pad and the second adhesive pad after the user awakens.

11. The method of claim 8, wherein the free end of the first tension strap is configured to be removably attached to an area of the second end of the first adhesive pad at a position that maintains the first tension in the desired region of skin.

12. The method of claim 11, wherein the maintaining the first tension in the desired region of skin comprises engaging a hook material applied on one of an undersurface of the first tension strap or a surface of the first adhesive pad with a loop material applied on the other one of the undersurface of the first tension strap or the surface of the first adhesive pad to hold the free end of the first tension strap in place after the free end of the first tension strap is pulled toward the second end of the first adhesive pad to create the first tension.

13. The method of claim 12, wherein a refastenable adhesive material is disposed on at least one of the undersurface of the first tension strap and the surface of the first adhesive pad, and wherein maintaining the first tension in the desired region of skin comprises adhering the undersurface of the first tension strap to the surface of the first adhesive pad such that the free end of the first tension strap is held in place after it is pulled toward the second end of the first adhesive pad to create the first tension.

14. The method of claim 11, where pulling the free end of the first tension strap toward the second end of the first adhesive pad to create the first tension in the desired region of skin includes applying digital pressure against a surface of the first adhesive pad such that the first adhesive pad conforms to skin under the adhesive pad as the first tension in the skin in the desired region of skin is created.

* * * * *